United States Patent [19]

Halelka et al.

[11] Patent Number: 4,674,696

[45] Date of Patent: Jun. 23, 1987

[54] GROOVED ROTARY YARN DISTRIBUTOR FOR WINDING CYLINDRICAL BOBBINS

[75] Inventors: Jilji Halelka; Petr Jirasko; Zdenek Koloc; Miroslav Vaclavik, all of Liberec, Czechoslovakia

[73] Assignee: Elitex koncern textilniho strojirenstvi, Liberec, Czechoslovakia

[21] Appl. No.: 840,516

[22] Filed: Mar. 17, 1986

[30] Foreign Application Priority Data

Mar. 18, 1985 [CS] Czechoslovakia ..... PV 1885-85

[51] Int. Cl.[4] ..... B65H 54/28; B65H 54/48

[52] U.S. Cl. ..... 242/43.2

[58] Field of Search ..... 242/43.2, 43 R, 18 DD

[56] References Cited

U.S. PATENT DOCUMENTS

| | | | |
|---|---|---|---|
| 1,749,355 | 3/1930 | Reece | 242/43.2 |
| 1,836,105 | 12/1931 | Bood | 242/43.2 |
| 1,918,210 | 7/1933 | McKean | 242/43.2 |
| 2,969,198 | 1/1961 | Wolff | 242/43.2 |
| 2,998,203 | 8/1961 | Pitts | 242/43.2 |
| 3,801,034 | 4/1974 | Tsukuma et al. | 242/43.2 |
| 3,945,581 | 3/1976 | Schippers et al. | 242/43.2 |

FOREIGN PATENT DOCUMENTS

| | | | |
|---|---|---|---|
| 12739 | 9/1962 | Japan | 242/43.2 |
| 683508 | 11/1952 | United Kingdom | 242/43.2 |

*Primary Examiner*—Stanley N. Gilreath

[57] ABSTRACT

The present invention relates to a grooved rotary yarn distributor for winding bobbins of cylindrical shape, the distributor having a reversible, crossing helical groove and a variable radius of the groove bottom. The distributor is intended for winding of cylindrical bobbins with a constant crossing angle of the wound yarn, the bobbin being employed in textile machines. The bottom of the yarn distributing groove of the distributor has a first derivative of the axial coordinate of the bottom of the groove according to the angular coordinate in a raising function of the angular coordinate at or close to a selected point, when the first derivative of the radius of the groove bottom according to the angular coordinate is a rising function of the angular coordinate at or close to the selected point, and decreases in the case when the first derivative of the radius of the groove bottom according to the angular coordinate is a decreasing function of the angular coordinate at or close to the selected point upon the rising of the axial coordinate of the groove bottom in the direction of distribution of the yarn from zero to a maximum value of the stroke of the grooved rotary yarn distributor.

2 Claims, 6 Drawing Figures

GROOVED ROTARY YARN DISTRIBUTOR FOR WINDING CYLINDRICAL BOBBINS

This application is related to the coassigned application Ser. No. 840,595, filed Mar. 17, 1986.

The present invention relates to a grooved rotary yarn distributor of cylindrical shape, such distributor having a reversible, crossing, helical groove, the bottom of the groove being of variable radius. Said yarn distributor is intended for winding yarn onto cylindrical bobbins with a constant crossing angle of the helix of the wound yarn, the bobbins being for use in textile machines.

In previously known grooved rotary yarn distributors of the above-indicated type, the rise of the groove or of its bottom passes over continuously from a minimum to a maximum value. Those rotary distributors, which have a variable radius of the groove bottom, and in which the distance of the point of contact of the yarn at the groove bottom and the point of contact of the yarn on the bobbin is variable, do not wind the yarn onto the bobbin with the necessary constant crossing angle.

Grooved rotary yarn distributors for winding cross wound bobbins with a constantly varying rise of the groove in both groove cylinders are known; those parts of the groove, which guide the yarn from the ends to its center, have a higher rise then those parts of the groove which guide the yarn from the center of the bobbin to its end. In such distributors, in the same axial sections thereof, the sums of the two lengths of the two sections on both branches of the groove, in the center of the lift yarn groove, are of at least the same value as the sum of the lengths of the two groove sections of the grooved rotary yarn distributor at the ends of the lift yarn path. The course of the sums of the lengths in both branches of the groove are continuous in the parts of the grooved rotary yarn distributor which follows each other.

The disadvantage of the above known types of grooved rotary yarn distributors is that they do not meet the requirement of depositing yarn at a constant density on the bobbin within a flange-shaped outline of the bobbin jacket.

The present invention has among its objects the mitigation of the above disadvantage for the prior art by approaching the ideal shape of winding while maintaining its constant density along the whole extent of the winding. It is a further purpose of the present invention to make it possible to machine the grooved rotary yarn distributor on numerically controlled (NC) milling machines with a continuous path control.

The above objects are attained by a grooved rotary yarn distributor, according to the present invention. In such rotary yarn distributor, the first derivative of the axial coordinates of the bottom of the distributor groove according to the angular coordinate thereof, is an increasing function of such angular coordinate in the neighborhood of at or close to a selected point C and is a decreasing function in the case in which the first derivative of the radius of the groove bottom, according to the angular coordinate, is a decreased point C upon the growth of the actual coordinate in the direction of distribution $S_1$ or $S_2$ from zero up to the maximum value of the upstroke of the grooved rotary yarn distributor.

The axial coordinate at the selected point C is, in view of the axial coordinate of the imaginary helix with a constant lead axially displaced within the range of $\pm 10$ mms, according to the crossing angle of the yarn on the cylindrical bobbin, the diameter and the shape of the distributor.

The advantage of the grooved rotary yarn distributor, according to the present invention, consists in that the inconvenient effect of the variable radius of the groove bottom is removed, particularly at the point of crossing of the groove in relation to the structure of the winding, the wound bobbin having a substantially more even density in hardness of the winding.

Further advantages and features of the present invention will become more readily apparent from the exemplary embodiment of the rotary yarn distributor, diagrammatically shown in the accompanying drawings in which.

Figure 5:
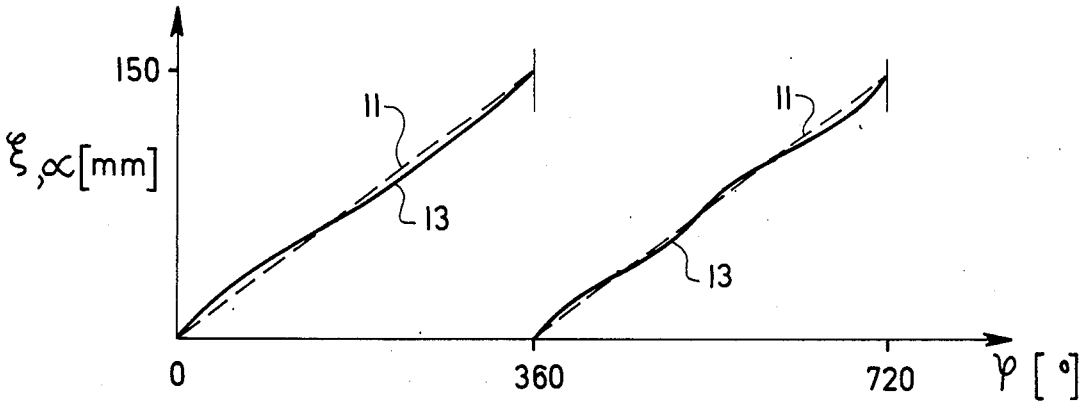
Figure 6:
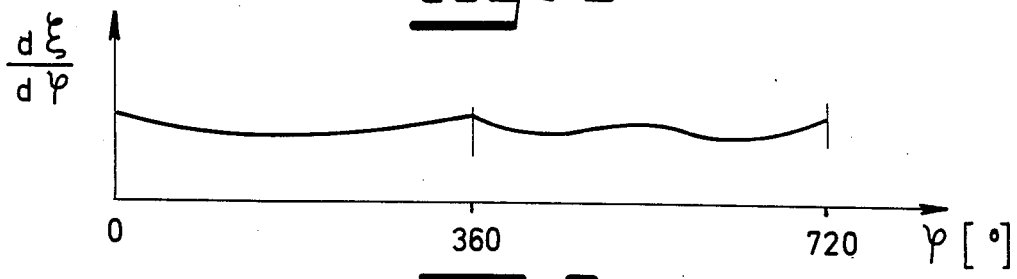

FIG. 5 is a graph of the function of the axial coordinate $\xi$ (xi) of the groove bottom points of the grooved rotary distributor and the axial coordinate $\alpha$ (alpha) of the imaginary helix with the constant lead in dependence upon the angle $\psi$; and FIG. 6 is a groove of the function of the first derivative of the axial coordinate $\xi$ of the groove bottom points of the grooved rotary distributor according to the angle symbol $\psi$ in dependence upon the angle $\psi$.

Figure 1:
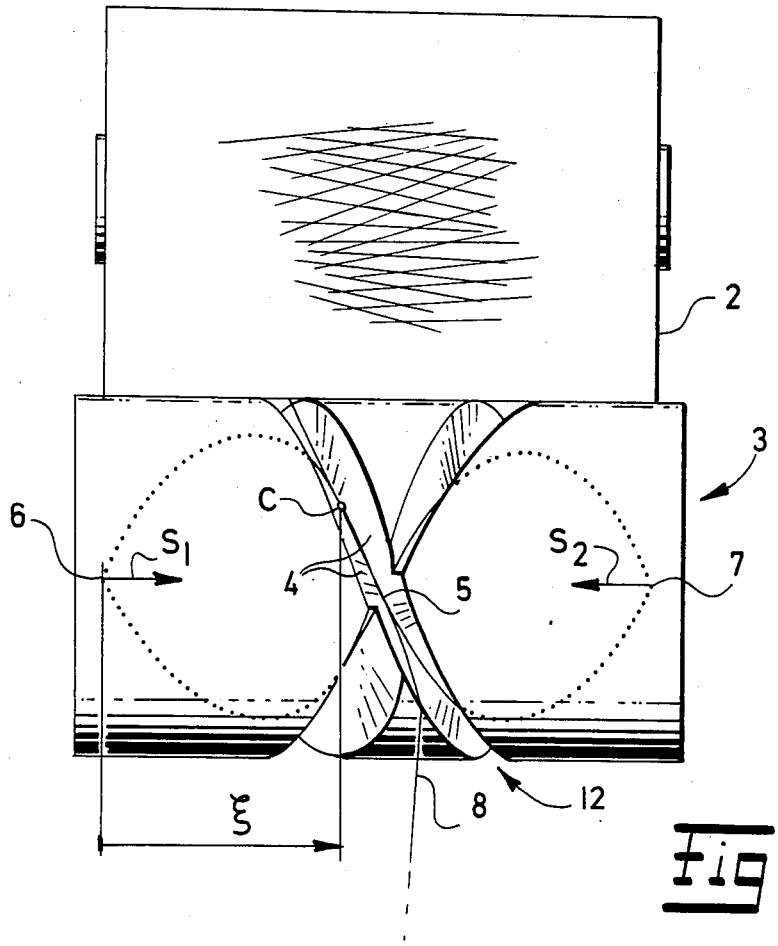
FIG. 1 is a view in elevation of the grooved rotary yarn distributor.
Figure 2:
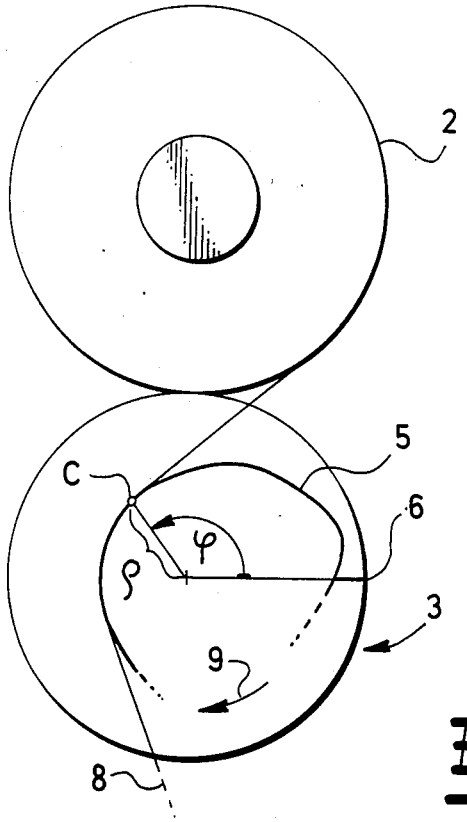
FIG. 2 is a view in side elevation taken in the direction from right to left in FIG. 1.

Turning first to FIGS. 1 and 2, the grooved rotary yarn distributor 3 for yarn 8 is provided with a reversible, crossing groove 12 with two walls 4, a bottom 5, and a variable radius $\rho$. A cylindrical bobbin 2 bears against and rolls about the grooved rotary yarn distributor 3 for the yarn 8. The angle between the walls 4 of groove 12 is such that the yarn 8 leaves the bottom 5 of groove 12 on bobbin 2 along a straight line in such manner that yarn 8 is not bent about wall 4. From this it follows that yarn 8 is distributed by the bottom 5 of the groove 2 from which the yarn leaves at point C, as shown in FIGS. 1 and 2. Thus, yarn 8 is always distributed relative to the turning of the grooved rotary yarn distributor 3 by the appurtenant C of the bottom 5 of groove 12; point C is actually a imaginary yarn guide for the yarn 8, moving between the dead centers 6, 7, of groove 12.

For the definition of the bottom 5 of groove 12 of grooved rotary yarn distributor 3, three cylindrical coordinates are used These are:

(1)The axial coordinate $\xi$ in the direction of axis of rotation of the grooved rotary yarn distributor 3 with the beginning at the dead centers 6 or 7 of the grooved rotary yarn distributor 3, (2)The angular coordinate $\psi$ measured in a plane perpendicular to the axis of the grooved rotary yarn distributor 3 from the dead point 6 in the direction 9, opposite to the direction of rotation of the grooved rotary yarn distributor 3, upon winding the yarn 8 onto the bobbin 2 from the zero position to the maximum angular value corresponding to a double stroke of the grooved rotary yarn distributor 3, this being a maximum angle of 720 degrees (3) The third coordinate defining the bottom 5 of groove 12 is the radial coordinate $\rho$, i.e. the radius of the bottom 5 of groove 12.

The motion of the imaginary distributor eyelet for yarn 8, i.e. of point C, is governed in such a manner that the yarn 8, approaching bobbin 2, fulfills the given conditions for the theoretical winding, i.e. a constant density and hardness. This means that the individual positions of point C are determined on the basis of the shape of the theoretical winding and mutual properties of the functions $\rho=\rho(\psi)$, and $\xi=\xi(\psi)$ in the neighborhood of the selected position of point C at the bottom 5 of groove 12 of the grooved rotary yarn distributor 3 for yarn 8.

The theoretical winding on the cylindrical bobbin 2 with a constant crossing angle of yarn 8, which fulfills conditions of constant density and hardness, is a cylindrical helix with a constant rise (pitch). The angle of crossing of yarn 8 is defined by the double value of the acute angle between the line tangent to yarn 8 and the line normal to the axis of bobbin 2.

The course of the radius $\rho$ on the bottom 5 of groove 12 is such that at the point of crossing of the groove 12, a minimum difference of the radii $\rho$ of the crossing sections of the groove must be such as to guarantee safe guiding of the yarn in both directions $S_1$ $S_2$. In the remaining parts of the bottom 5 of groove 12, it is suitable to maintain the condition of constant passage of radius $\rho$ from one value to other. From this it follows that the condition of accurate and perfect distribution of the yarn in the directions $S_1$ and $S_2$ is a primary consideration, which at the same time determines the course of the function $\rho=\rho(\psi)$. The rectilinear section of yarn 8 between the grooved rotary yarn distributor 3 and bobbin 2, as shown in FIG. 2, is not of zero value and changes in dependence upon the course of the function, $\rho=\rho(\psi)$ of the radius $\rho$ of bottom 5 of groove 12. Therefore, the value of the axial coordinates $\xi$ of the selected point C of the bottom 5 of groove 12 is such, in view of the course of the function $\rho=\rho(\psi)$ in the neighborhood of the selected point C, that the yarn 8 leaves the bottom 5 of groove 12, a line which is tangent to the theoretical line of winding of yarn 8 of bobbin 2.

For the purpose of determining the course of the axial coordinate $\xi$ in dependence upon the angle $\psi$ i.e. the course of the function, $\xi=\xi(\psi)$ in the exemplary embodiment for a cylindrical bobbin 2 in accordance with FIG. 1, and an exemplary grooved rotary yarn distributor for the yarn 8 has a cylindrical shape with a diameter of 160 mms, a stroke 150 mms, and 1 crossing of groove 12, i.e. 1 double stroke. One double stroke is performed by the turning of the grooved rotary yarn distributor 3 throughout an angle to 720 degrees.

Figure 3:
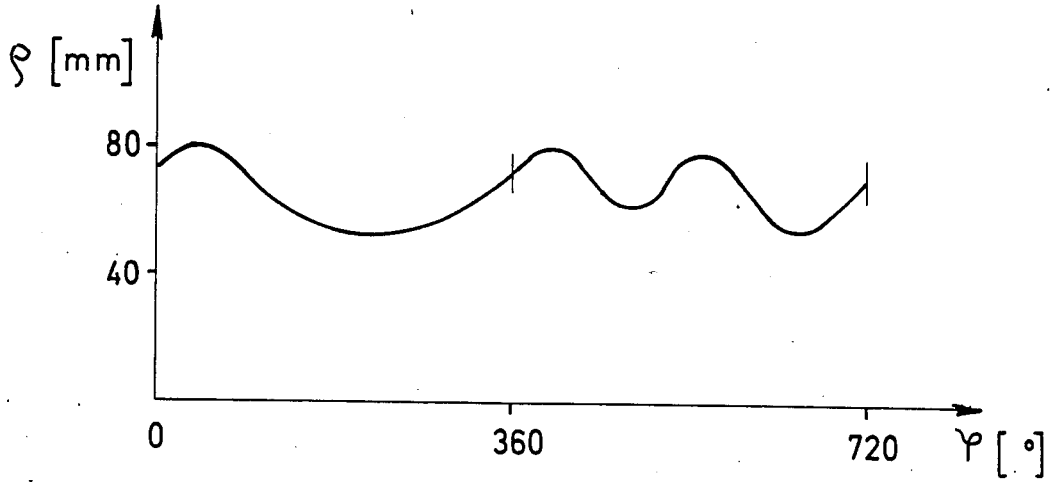
FIG. 3 is a graph of the function of the radius $\rho$ (rho) of the groove bottom of the grooved rotary yarn distributor in the dependence upon the angle $\psi$ (psi)
Figure 4:
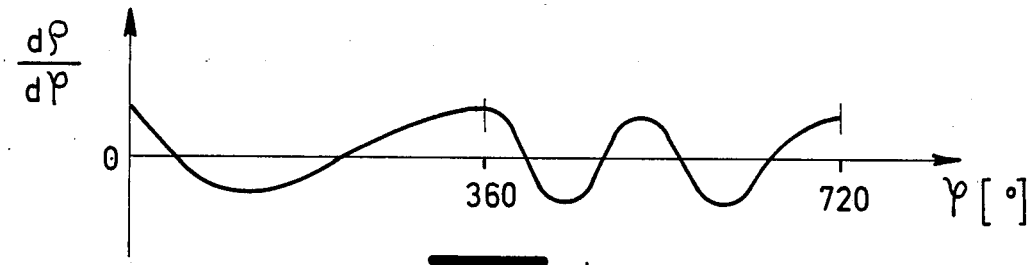
FIG. 4 is a graph of the function of the first derivative of the radius $\rho$ of the groove bottom of the groove rotary distributor in accordance with the angle $\psi$ depending upon the angle $\psi$.

The course of radius $\rho$ of the bottom 5 of the groove 12 in dependence upon angle $\psi$ in the double stroke section, with respect to the condition as given above is shown in FIG. 3, which on the vertical axis, a radius $\rho$ on the bottom 5 of groove 12 is plotted, an angle $\psi$ on the horizontal axis. For a radius $\rho$ of the bottom 5 of groove 12 selected in that manner, the character of the first derivative of radius $\rho$ of bottom of groove 12, according to angular coordinate $\psi$, is drawn in FIG. 4 as a function of coordinate $\psi$. On the vertical axis, the values of the first derivatives ($d\rho/d\psi$) are plotted, and on the horizontal axis, coordinate $\psi$ is plotted in the double strokes section.

In the graph of FIG. 6. the first derivative of coordinate $\xi$ with respect to $\psi$ is plotted against the value of the angle $\psi$ from zero to 720 degrees. The character of this function, and thus, also the shape of the bottom 5 of groove 12 of the grooved rotary yarn distributor 3 is determined from the condition of the theoretical winding of the cylindrical bobbin 2 with a constant density and hardness in such manner that the first derivative of axial coordinate $\xi$ according to the angular $\psi$ is an increasing function of angular coordinate $\psi$ in the environment of the selected point C in the case when the first derivative of the radius $\rho$ of the bottom 5 of groove 12, according to the angular coordinate $\psi$ is an increasing function of the angular coordinate $\psi$ in the environment of the selected point C and is a decreasing function when the first derivative of the radius $\rho$ of bottom 5 of groove 12 is, according to the angular coordinate $\psi$, a decreasing function of the angular coordinate $\psi$ in the environment of the selected point C upon increase of the axial coordinate $\xi$ in the direction of distribution $S_1$ or $S_2$ from zero to the maximum value of stroke of the grooved rotary distributor 3 of the yarn 8.

According to the course of the function in FIG. 6, the character of the function $\xi=\xi(\psi)$ in FIG. 5 is given, i.e. the axial coordinate of the separate positions of point C. The axial coordinate $\xi$ of the real helix with a proportional rise of bottom 5 of groove 12 of the grooved rotary yarn distributor 3 for winding yarn 8 onto the cylindrical bobbin 2 are relative to the axial coordinate $\alpha$ of the imaginary helix with a constant rise axially displaced within the range $\pm 10$ mms, according to the crossing angle of the yarn on the bobbin the diameter in the shape of the distributor. In FIG. 5, the dependence $\xi=\xi(\psi)$, relating to the bottom 5 of groove 12 of the grooved rotary yarn distributor 3 for winding yarn onto a cylindrical bobbin 2, is thus drawn in full lines, while the dependence $\alpha=\alpha(\psi)$ of the imaginary helix with a constant rise is drawn by a --line 11. On the vertical axis, the axial coordinate of the real helix 13 with the variable rise of the bottom 5 of groove 12, and the axial coordinate $\alpha$ of the imaginary helix 11 with a constant rise are plotted. On the horizontal axis, the angular coordinate $\psi$ in the double stroke section is plotted.

Upon winding yarn 8 onto the cylindrical bobbin 2, the grooved rotary yarn distributor 3 rotates in the direction 9. By determining the coordinate $\xi$ for the separate position point C of the bottom 5 of groove 12, i.e. by determining the course of the function $\xi=\xi(\psi)$ according to the given function $\rho=\rho(\psi)$. The condition is attained from the distribution point C (the imaginary yarn 8 distributing eyelet). The yarn is delivered in a direction which approaches the direction of the tangent line of the theoretical winding of yarn 8 on the cylindrical bobbin 2. The condition of constant density and hardness within the entire extent of the winding is fulfilled. Simultaneously, the angle between the walls 4 of the groove 12 is such that the yarn 8 comes out from the bottom 5 of groove 12 onto the cylindrical bobbin 2 about a straight line, and the yarn 8 does not bend about wall 4.

The rotary yarn distributor of the present invention is intended particularly for use in textile machines in which the cylindrical bobbins are wound by means of grooved rotary yarn distributors. In the exemplary embodiment, the V-shaped groove is formed by a conical cutter; however, it is also possible to use the cutter in the form of a frustrum cone or a cylinder. In that case, the bottom of the groove is considered to be that edge of the groove bottom, by means of which the yarn is guided in the grooved rotary yarn distributor. This edge determines the separate positions of point C in the exemplary embodiment of the groove which is V-shaped.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a grooved rotary yarn distributor of cylindrical shape with a reversible, crossing helical groove, and a variable radius of the bottom of the groove. the distributor being intended for the winding of cylindrical bobbins with a constant crossing angle of the wound yarn for use on textile machines, the improvement which comprises that in the bottom of the distributor groove the first derivative of the axial coordinate of the bottom of the groove according to angular coordinate is a rising function of the angular coordinate at or close to, a selected point in the case when the derivative of the radius of the bottom of the groove according to the angular coordinate is a rising function of the angular coordinate at or close to the selected point, and is decreasing in the case in which the first derivative of the radius of the bottom of the groove according to the angular coordinate is a decreasing function of the angular coordinate at or close to the selected point upon the rising of the axial coordinate of the bottom of the groove in the direction of distribution from zero to the maximum value of the stroke of the grooved rotary yarn distributor.

2. Grooved rotary yarn distributor as claimed in claim 1, wherein in the axial coordinate in the selected point of the helix with a variable rising of the bottom of the groove is in relation to the axial coordinate of the imaginary helix with a constant rising axial displacement within the range of $\pm 10$ mms according to the crossing angle of the yarn on the cylindrical bobbin, the diameter and the shape of the grooved rotary yarn distributor.

* * * * *

UNITED STATES PATENT AND TRADEMARK OFFICE

CERTIFICATE OF CORRECTION

PATENT NO. : 4,674,696

DATED : June 23, 1987

INVENTOR(S) : Jilji Havelka et al.

It is certified that error appears in the above-identified patent and that said Letters Patent is hereby corrected as shown below:

On the title page, Item [19], "Halelka et al." should read

-- Havelka et al. --.

Item [75] "Jilji Halelka" should read

-- Jilji Havelka --.

Signed and Sealed this

Twenty-seventh Day of October, 1987

*Attest:*

DONALD J. QUIGG

*Attesting Officer*

*Commissioner of Patents and Trademarks*